US011444417B2

(12) United States Patent
Nikfal et al.

(10) Patent No.: US 11,444,417 B2
(45) Date of Patent: Sep. 13, 2022

(54) RF CONNECTOR ELEMENT AND RF CONNECTOR SYSTEM

(71) Applicants: TE Connectivity Germany GmbH, Bensheim (DE); TE Connectivity Services GmbH, Schaffhausen (CH)

(72) Inventors: Mohammad Nikfal, Bensheim (DE); Christian Mandel, Bensheim (DE); Chang Hyo Yun, Schaffhausen (CH); Abiel Kidane, Bensheim (DE)

(73) Assignees: TE Connectivity Germany GmbH, Bensheim (DE); TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/983,397

(22) Filed: Aug. 3, 2020

(65) Prior Publication Data

US 2021/0036471 A1 Feb. 4, 2021

(30) Foreign Application Priority Data

Aug. 2, 2019 (EP) ..... 19189826

(51) Int. Cl.
*H01R 24/40* (2011.01)
*H01R 103/00* (2006.01)

(52) U.S. Cl.
CPC ..... *H01R 24/40* (2013.01); *H01R 2103/00* (2013.01)

(58) Field of Classification Search
CPC ..... H01R 13/6473; H01R 13/6474; H01R 13/6477; H01R 24/40; H01R 2103/00
See application file for complete search history.

(56) References Cited

U.S. PATENT DOCUMENTS 3,366,920 A * 1/1968 Laudig ..... H01R 24/44 439/581
4,619,496 A * 10/1986 Forney, Jr. ..... H01R 24/40 439/434
5,041,020 A * 8/1991 Michael ..... H01R 24/44 439/578

(Continued)

FOREIGN PATENT DOCUMENTS

WO 2007146157 A2 12/2007

OTHER PUBLICATIONS

Extended European Search Report, European Application No. 19189826.1-1201, European Filing Date, dated Jan. 31, 2020.

*Primary Examiner* — Oscar C Jimenez
(74) *Attorney, Agent, or Firm* — Barley Snyder

(57) ABSTRACT

A first RF connector element mating with a second RF connector element includes a first terminal having a first contact region, a second terminal having a second contact region, and a first electrical insulator element electrically insulating the first terminal and the second terminal. The first electrical insulator element has a first contact support part and a first compensation part. The first contact support part is integrally formed of a first dielectric material and has a first relative dielectric constant. The first compensation part is integrally formed with the first contact support part of a second dielectric material, the second dielectric material having a second relative dielectric constant greater than the first relative dielectric constant. The first compensation part is arranged at a front end region of the first electrical insulator element and at least partly encompasses the first contact region.

20 Claims, 9 Drawing Sheets

(56) References Cited

U.S. PATENT DOCUMENTS

| | | | | |
|---|---|---|---|---|
| 5,066,249 | A * | 11/1991 | Doye | H01R 9/0518 439/585 |
| 7,347,721 | B2 * | 3/2008 | Kameyama | H01R 13/6477 439/498 |
| 9,620,900 | B2 * | 4/2017 | Yanase | H01R 13/6315 |
| 9,960,542 | B2 * | 5/2018 | Holland | H01R 13/6581 |
| 10,630,032 | B2 * | 4/2020 | Holland | H01R 13/6474 |
| 2013/0102187 | A1 | 4/2013 | Camelio et al. | |
| 2015/0162696 | A1 | 6/2015 | Morley | |
| 2020/0006891 | A1 * | 1/2020 | Miyamura | H01R 13/506 |

* cited by examiner

RF CONNECTOR ELEMENT AND RF CONNECTOR SYSTEM

CROSS-REFERENCE TO RELATED APPLICATION

This application claims the benefit of the filing date under 35 U.S.C. § 119(a)-(d) of European Patent Application No. 19189826, filed on Aug. 2, 2019.

FIELD OF THE INVENTION

The present invention relates to a connector element and, more particularly, to a radio frequency (RF) connector element.

BACKGROUND

RF connectors, such as coaxial connectors, twin-axial connectors, or universal serial bus (USB) connectors, and RF connector systems are used to connect the transmission lines of RF cables for transmitting radio frequency RF signals with an operation bandwidth of several GHz. Conventional coaxial connectors, for example, comprise an inner conductor, which serves for connecting the transmission lines of coaxial cables and which is provided in a central part of the coaxial connector. An outer conductor, which serves as a grounding line and shields the inner conductor, is provided around the inner conductor. For electrically insulating the inner conductor and the outer conductor and for stabilizing the coaxial connector, an electrical insulator element is provided in the gap between the outer conductor and the inner conductor Conventional twin-axial connectors and USB connectors comprise a plurality of inner conductors, which each serve for connecting respective transmission lines of corresponding twin-axial or USB cables. Therefore, an electrical insulator element provided in a twin-axial or USB cable does not only electrically insulate the plurality of inner conductor from a shielding outer conductor, but also electrically insulates the plurality of inner conductors from each other.

Modern applications are focused on providing higher data rate communication links by the transmission line, especially for applications in the automotive and the information and communications technology (ICT) industry. For this purpose, it is necessary to maintain a homogeneous impedance through the whole transmission system including the RF connector and the RF cables, since discontinuities in the impedance lead to reflections of the radio frequency signals and therefore cause losses in the signal transmission performance. Hence, it is necessary to match the impedance of the RF connector with the impedance of connected RF cables and to provide a homogeneous impedance throughout the RF connector in order to avoid impedance inhomogeneity in the transmission system.

On the other hand, it is also a goal to miniaturize the RF connectors and to allow the use of simple fastening mechanisms, which only require linear motions like snap-fit connections, levers or slides, and make it possible to provide cheap, light and space-saving RF connectors. Although such fastening mechanisms further allow a simple mating of a RF connector, for example in a vehicle, they also decrease the signal transmission performance of the RF connector due to unavoidable mating tolerances.

SUMMARY

A first RF connector element mating with a second RF connector element includes a first terminal having a first contact region, a second terminal having a second contact region, and a first electrical insulator element electrically insulating the first terminal and the second terminal. The first electrical insulator element has a first contact support part and a first compensation part. The first contact support part is integrally formed of a first dielectric material and has a first relative dielectric constant. The first compensation part is integrally formed with the first contact support part of a second dielectric material, the second dielectric material having a second relative dielectric constant greater than the first relative dielectric constant. The first compensation part is arranged at a front end region of the first electrical insulator element and at least partly encompasses the first contact region.

BRIEF DESCRIPTION OF THE DRAWINGS

The invention will now be described by way of example with reference to the accompanying Figures, of which.

DETAILED DESCRIPTION OF THE EMBODIMENTS

The accompanying drawings are incorporated into the specification and form a part of the specification to illustrate several embodiments of the present invention. These drawings, together with the description, serve to explain the principles of the invention. The drawings are merely for the purpose of illustrating examples of how the invention can be made and used, and are not to be construed as limiting the invention to only the illustrated and described embodiments.

Furthermore, several aspects of the embodiments may form—individually or in different combinations—solutions according to the present invention. The following described embodiments thus can be considered either alone or in an arbitrary combination thereof. Further features and advantages will become apparent from the following more particular description of the various embodiments of the invention, as illustrated in the accompanying drawings, in which like references refer to like elements.

As used herein, the term "radio frequency signal" relates to alternating current electric signals with an oscillation frequency of around 20 kHz to 20 GHz: However, the present invention may also be applied to frequency ranges above 20 GHz. The term "signal" refers to an analog signal, as well as to a digital signal. Further, in this disclosure, the term "relative dielectric constant" signifies the relative permittivity of a material. It is commonly understood, that the relative permittivity of a material is its absolute permittivity expressed as a ratio relative to the vacuum permittivity.

Figure 1:
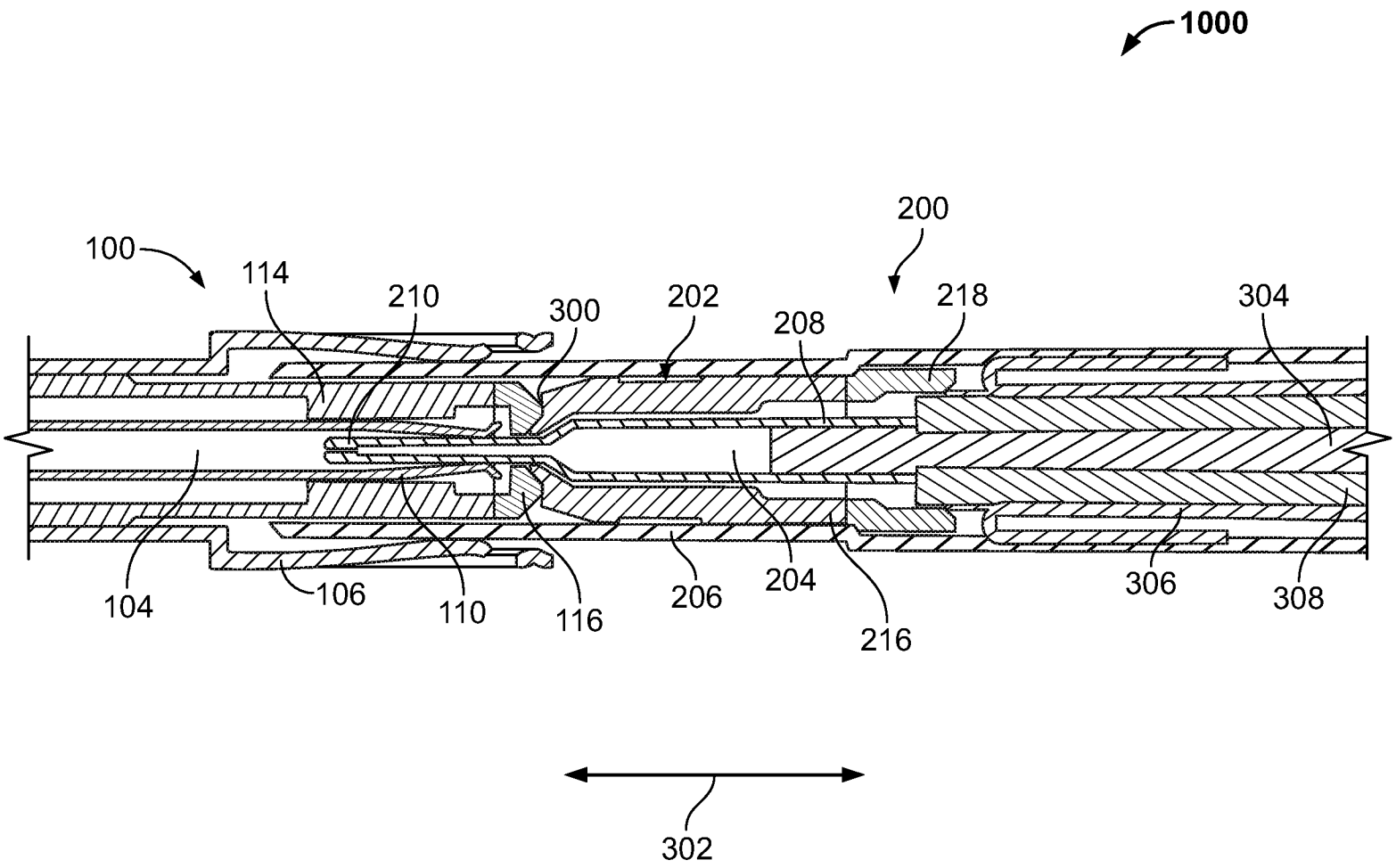
FIG. 1 is a sectional side view of an RF connector system according to an embodiment.
Figure 2:
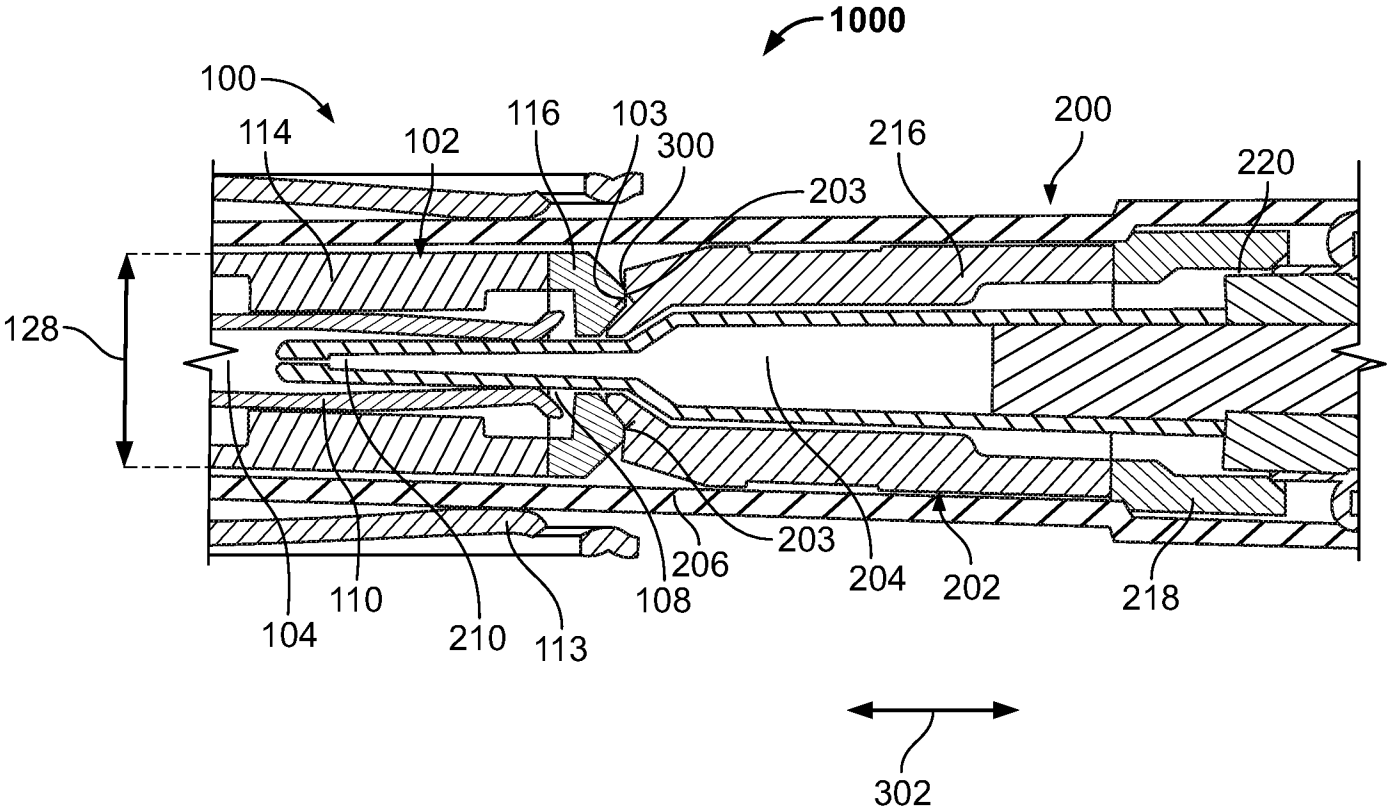
FIG. 2 is a detail view of a portion of FIG. 1.

An RF connector system according to an embodiment is shown in FIGS. 1 and 2. The RF connector system, in the shown embodiment, is a coaxial connector system 1000 and comprises a first coaxial connector element 100 and a second coaxial connector element 200. FIGS. 1 and 2 show an example of the coaxial connector system 1000, where an air gap 300 between a front surface 103 of a first electrical insulator element 102 and a front surface 203 of a second electrical insulator element 202 in a longitudinal direction 302, which is indicated in the figures by an arrow 302, is 0 mm. However, a length of the air gap 300 between the front surface 103 of the first electrical insulator element 102 and the front surface 203 of the second electrical insulator element 202 may, for example, vary in a range from 0 to 2 mm.

As shown in FIGS. 1 and 2, the first coaxial connector element 100 has the first electrical insulator element 102, a first inner conductor 104, which is one example of a first terminal, and a first outer conductor 106, which is one example of a second terminal. The first electrical insulator element 102 is arranged in between the first inner conductor 104 and the first outer conductor 106, for electrically insulating the first inner conductor 104 and the first outer conductor 106.

The second coaxial connector element 200, as shown in FIGS. 1 and 2, has a second electrical insulator element 202, a first mating inner conductor 204, which is one example of a first mating terminal, and a first mating outer conductor 206, which is one example of second mating terminal. The second electrical insulator element 202 is arranged in between the first mating inner conductor 204 and the first mating outer conductor 206, for electrically insulating the first mating inner conductor 204 and the first mating outer conductor 206. In the exemplary embodiment of FIGS. 1 and 2, the first coaxial connector element 100 is a receptacle, while the second coaxial connector element 200 is a pin.

In the following, the first coaxial connector element 100 is explained in greater detail with reference to FIGS. 1-3.

Figure 3:
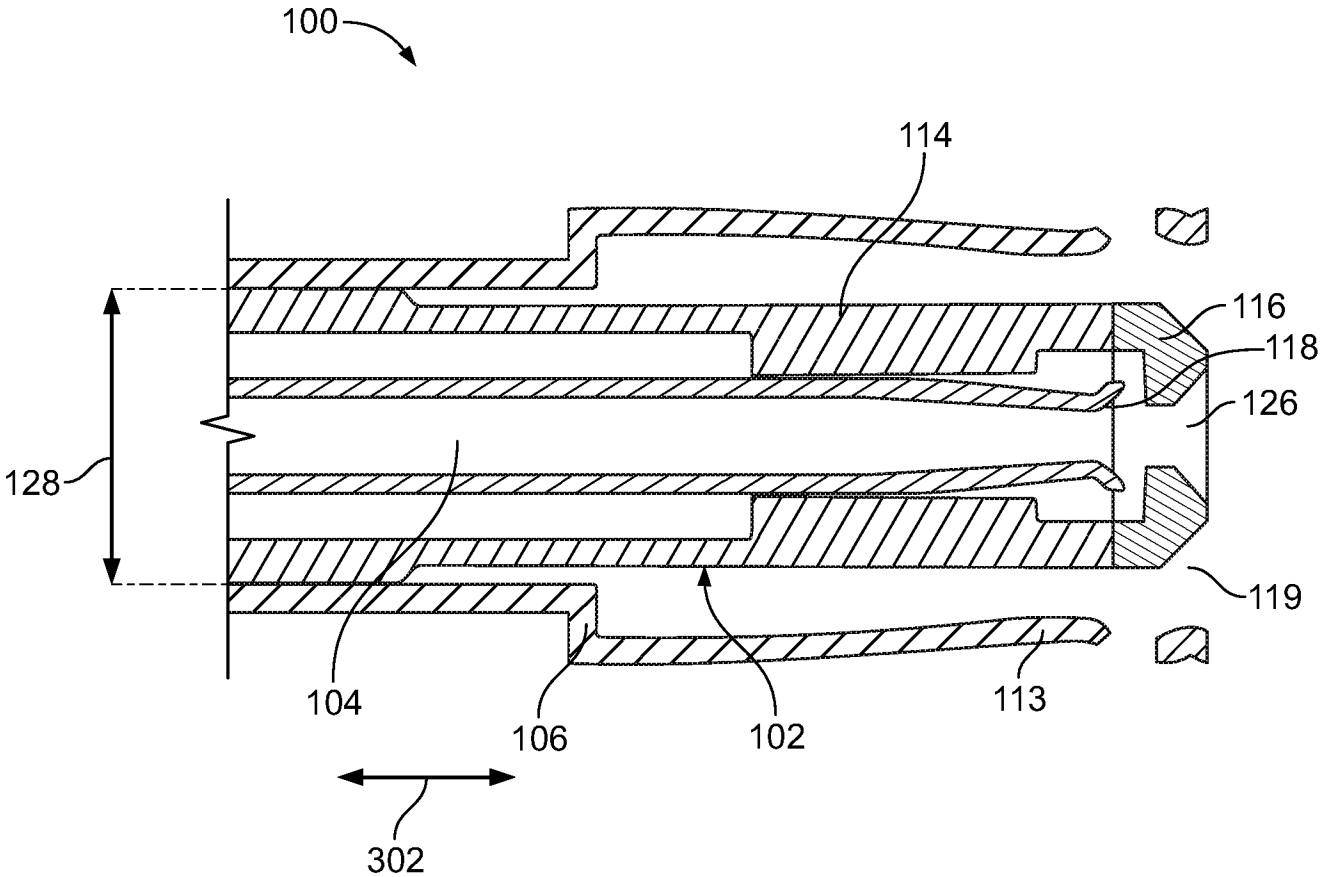
FIG. 3 is a sectional side view of a first RF connector element according to an embodiment.

The first inner conductor 104, as shown in FIGS. 1-3, has a first contact region 110 for electrically connecting the first inner conductor 104 to a first mating terminal contact region 210 of the second coaxial connector element 200. For that purpose, the first contact region 110 is formed as a hollow member and has a contact aperture 108, so that the first contact region 110 can receive the first mating terminal contact region 210. For electrically connecting a transmission line 304 of a coaxial cable element 305 to the first inner conductor 104, the first inner conductor 104 has a first terminal end region.

The first inner conductor 104 may comprise a first barb, which protrudes radially from a center of the first inner conductor 104. After manufacturing of the first coaxial connector element 100, the first barb may engage with a first recess of the first electrical insulator element 102. In this manner, the first barb can prevent the first inner conductor 104 from moving in a longitudinal direction 302 with respect to the first electrical insulator element 102, after the first coaxial connector element 100 is manufactured.

The first outer conductor 106 surrounds the first inner conductor 104 for shielding the first inner conductor 104. For ensuring that the first outer conductor 106 is electrically connected to the first mating outer conductor 206 in a state where the coaxial connector system 1000 is mated, the first outer conductor has a first spring 113, shown in FIGS. 2 and 3, which is adapted to press the first outer conductor 106 onto the first mating outer conductor 206. For electrically connecting a grounding line 306 of a coaxial cable element 305 to the first outer conductor 106, the first outer conductor 206 has a second terminal end region.

In an embodiment, the first outer conductor 106 has an outer conductor inspection opening, for enabling camera inspection of the alignment of the first inner conductor 104 with respect to the first electrical insulator element 102, after manufacturing of the first connector element 100.

The first electrical insulator element 102, as shown in FIGS. 1-3, has a first contact support part 114 and a first compensation part 116, which is integrally formed with the first contact support part 114, so as to form a single part. The first contact support part 114 is integrally formed of a first dielectric material, which has a first relative dielectric constant. In order to provide an isotropic electric insulation and an isotropic capacitance between the first inner conductor 102 and the first outer conductor 106, the first contact support part 114 may be substantially ring-shaped.

The first compensation part 116 is integrally formed of a second dielectric material, which has a second relative dielectric constant, which is larger than the first relative dielectric constant. As shown in FIGS. 1-3, the first compensation part 116 is arranged proximal to a front end portion 118 of the first contact region 110, so that the first compensation part 116 at least partly surrounds the first contact region 110 of the first inner conductor 104. Further, the first compensation part 116 may protrude above the front end portion 118 towards an opening 119 of the first coaxial connector element 100. In this manner, the first compensation part 116 increases the capacitance between the inner conductor 104 and the outer conductor 106 near the front end portion 118, and thus can compensate a capacitance drop that is caused by the air gap 300, when the coaxial connector system 1000 is mated.

In an embodiment, the first compensation part 116 is substantially ring-shaped, thus leading to an isotropic capacitance compensation in the neighborhood of the front end portion 118. Further, this geometry allows to easily stitch the first inner conductor 104 into the first electrical insulator element 102 during manufacturing of the first coaxial connector element 100. As apparent from FIG. 3, the first compensation part 116 may also have a compensation aperture 126. The compensation aperture 126 is capable of receiving the first mating terminal contact region 210 of the second coaxial connector element 200, so that the first compensation part 116 is capable of surrounding the first mating terminal contact region 210 at least partly, when the coaxial connector system 1000 is mated.

In order to enable camera inspection for controlling the alignment of the first inner conductor 104 with respect to the first electrical insulator element 102, the first electrical insulator element 102 may have an inspection opening in an embodiment, which extends radially into a center of the first electrical insulator element 102. In this way, it is possible to control via camera inspection, if the front end portion 118 of the first inner conductor 104 is aligned within the inspection opening after manufacturing of the first coaxial connector element 100.

Here, it should be noted, that the first compensation part 116 is arranged at least nearby the inspection opening. Hence, the first compensation part 116 also compensates a capacitance drop between the first inner conductor 104 and the first outer conductor 106 that is induced by the inspection opening, which is formed of air with a relative dielectric constant of 1.

In an embodiment, the first contact support part 114 is formed of a polymer, a resin or a rubber. For example, the first contact support part 114 is formed of a dielectric material, which is injection-moldable, such as a polyethylene (PE) or a polypropylene (PP). Alternatively, the first contact support part 114 may be formed of a material that is processed by ram extrusion, like polytetrafluoroethylene (PTFE), or may be formed of a dielectric material, which is a 3D-printable ceramic. Typically, such materials have a relative dielectric constant in a range between 1 and 5.

In an embodiment, the first compensation part 116 is formed of a material having a relative dielectric constant at least in a range between 8 and 35. In order to realize a second relative dielectric constant in such a range, the second dielectric material may be fabricated by ceramic powder filling of a plastic base material. For example, the first compensation part 116 may be formed of an injection-moldable polymer mixed with a mineral, such as barium titanate ($BaTiO_3$). By optimizing the volume fraction of the mineral, a range between 8 and 23 can be achieved for the second relative dielectric constant at a transmission signal frequency of 1 GHz. Alternatively, the second dielectric material may be any 3D-printable ceramic with a relative dielectric constant that is larger than the first dielectric constant of the first dielectric material. Further, the second dielectric material may be a dispensable semi-liquid mixed with a mineral. For example semi-liquids mixed with a mineral such as $BaTiO_3$ are known, that have a relative dielectric constant of 35 at a transmission signal frequency of 1 GHz.

In an embodiment, the first electrical insulator element 102 is manufactured by a fabrication process, which is known in the art as overmolding or as multi-material injection molding. Thereby, the first contact support part 114 is initially manufactured by injection molding of the first dielectric material and subsequently the first compensation part 116 is overmolded onto the first contact support part 116 by injection molding of the second dielectric material. In this manner, the first electrical insulator element 102 can be manufactured as a single part, so that the first coaxial connector element 100 can be assembled from the first electrical insulator element 102, the first inner conductor 104 and the first outer conductor 106 in a conventional manner.

Further, injection molding and overmolding are well-known methods and provide reliable and inexpensive manufacturing even for miniaturized coaxial connector elements. For example, it is possible with these techniques to manufacture the first electrical insulator element 102 with a first outer diameter 128 of 2 mm, and to fabricate the first compensation part 116 with a thickness of 0.6 mm in the longitudinal direction 302 and a diameter of the compensation aperture 126 of 0.6 mm. However, these dimensions are merely given as examples, to illustrate the length scales of a miniaturized first coaxial connector element 100, and are not meant to be restrictive, as the aspects of the present invention may also be applied to a coaxial connector system with larger or even smaller dimensions.

Alternatively, the first compensation part 116 may be fabricated by dispensing a dispensable semi-liquid in a dispensing volume after the first contact support part 114 is manufactured. As another alternative, 3D printing may be used in combination with suitable dielectric materials to manufacture the first electrical insulator element 102 as a single part comprising the first contact support part 114 and the first compensation part 116.

It may be further useful to vary the thickness of the first compensation part 116 in the longitudinal direction 302, for example in a range between 0.2 mm to 0.8 mm, based on a ratio of the first relative dielectric constant and the second relative dielectric constant. To optimize the operation bandwidth and the signal transmission performance of the first RF connector element 100, the ratio between the first relative dielectric constant and the second relative dielectric constant is in a range between 1/35 and 5/8.

For example, the thickness of the first compensation part 116 in the longitudinal direction 302 can be increased, when the ratio between the first relative dielectric constant and the second relative dielectric constant decreases, and can be decreased, when the ratio between the first relative dielectric constant and the second relative dielectric constant increases. In this way, it is possible to optimize the compensation of the capacitance drop caused by the air gap 300 and to further enhance the signal transmission performance of the first coaxial connector element 100.

Alternatively, the thickness of the first compensation part 116 may be varied based on a maximum compensation length, which is the maximum length of the air gap 300 in the longitudinal direction 302, for which the capacitance drop caused by the air gap 300 is compensated without substantial decrease of the data transmission performance. For example, the thickness of the first compensation part 116 may be 0.5 to 1.5 times the length of the maximum compensation length. For example, for achieving a tolerance towards an air gap 300 up to 1 mm, the thickness of the first compensation part 116 may be varied in a range between 0.5 mm and 1.5 mm.

FIGS. 1-3 shows an embodiment in which the RF connector system is a coaxial connector system 1000, hence comprising a single inner conductor for transmitting a RF signal, and an outer conductor for shielding the inner conductor. However, the present invention is not limited to such connector systems, but may also be applied to RF connector systems, such as twin-axial connector systems or USB connector systems, which comprise a plurality of inner conductors, either shielded or unshielded.

Figure 4:
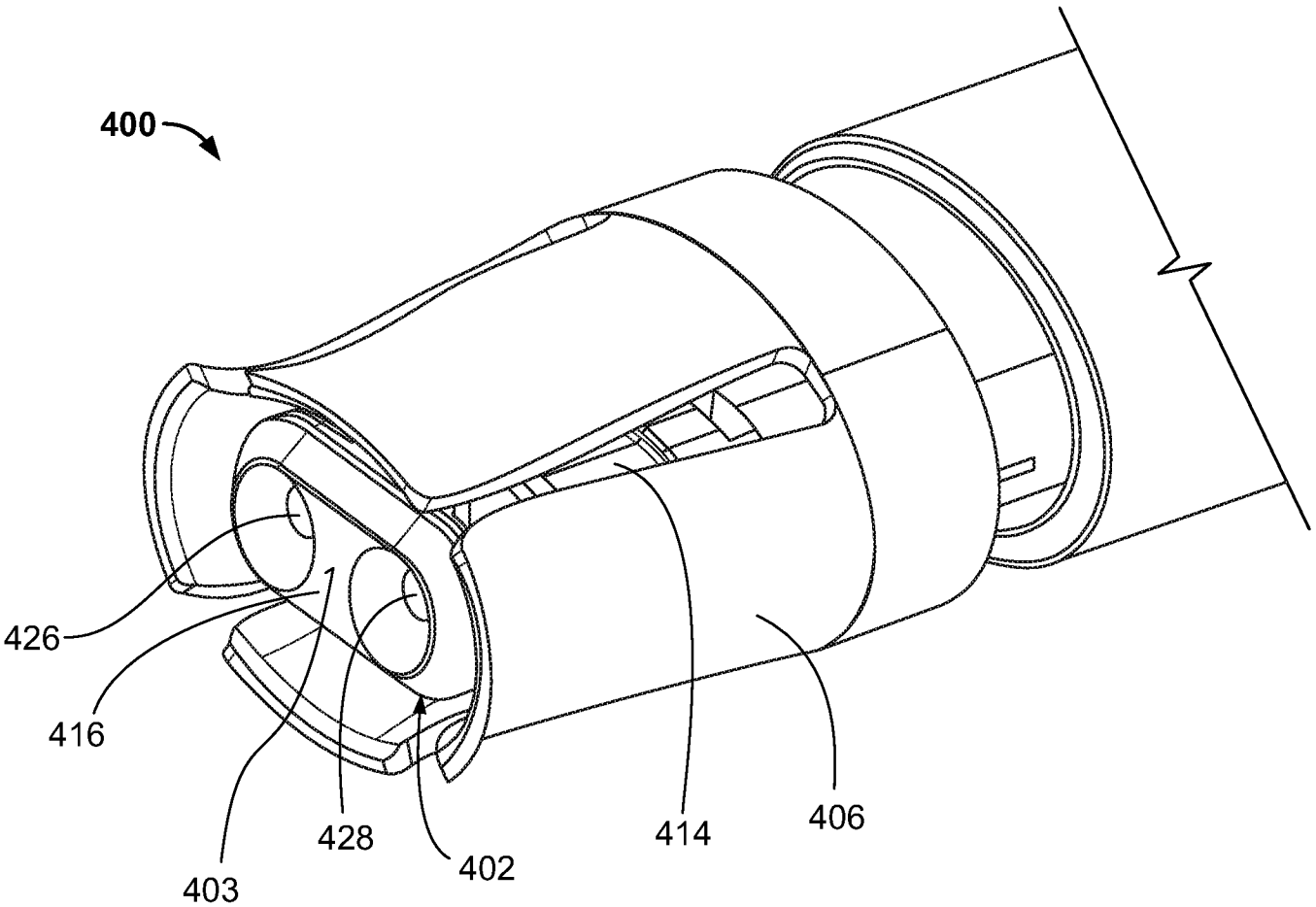
FIG. 4 is a perspective view of a first RF connector element according to another embodiment.

FIG. 4 shows a schematic top view of the first RF connector element according to a second embodiment of the present invention. In the example of the second embodiment, the RF connector system is a twin-axial connector system and the first RF connector element is a first twin-axial connector element 400. The first twin-axial connector element 400 comprises a first inner conductor, which is one example of a first terminal, and a second inner conductor, which is one example of a second terminal. The first inner conductor has a first contact region for electrically connecting a first mating inner conductor, which is one example of a first mating terminal, and the second inner conductor has a second contact region for electrically connecting a second mating inner conductor, which is one example of a second mating terminal. Here, the first inner conductor and the second inner conductor are exemplified by receptacles and may be substantially equivalent to the first inner conductor 110 of the first embodiment. However, of course the first inner conductor and the second inner conductor may also be pins.

The first twin-axial connector element 400, as shown in FIG. 4, has a first electrical insulator element 402, which electrically insulates the first inner conductor from the second inner conductor. In an embodiment, a first outer conductor 406, which surrounds the first inner conductor and the second inner conductor, may be provided for shielding the first inner conductor and the second inner conductor. In this case, the first electrical insulator element 402 is arranged to electrically insulate the first inner conductor and the second inner conductor from the first outer conductor 406.

As shown in FIG. 4, the first electrical insulator element 402 has a first contact support part 414, which is integrally formed of a first dielectric material, having a first relative dielectric constant, and a first compensation part 416, which is integrally formed of a second dielectric material, having a second relative dielectric constant, which is larger than the first relative dielectric constant. The first compensation part 416 is integrally formed with the first contact support part 414. The first compensation part 416 is arranged at a front end region of the first electrical insulator element 402, so that the first compensation part 416 at least partly encompasses the first contact region and the second contact region.

In an embodiment, the first compensation part 416 is substantially ring-shaped and has a first compensation aperture 426 and a second compensation aperture 428. The first compensation aperture 426 is capable pf receiving a first mating contact region of the first mating inner conductor, and the second compensation aperture 428 is capable of receiving a second mating contact region of the second mating inner conductor. In this manner, the first compensation part 416 surrounds the first mating contact region and the second mating contact region at least partly, when the twin-axial connector element 400 is mated with a mating twin-axial connector element.

In this manner, the first compensation part 416 increases the capacitance between the first inner conductor and the second inner conductor, as well as between each of the first and second inner conductors and the first outer conductor 406 near the first and second contact regions. Thus, a capacitance drop can be compensated, that is induced by an air gap at a front surface 403 of the first electrical insulator element 402, when the twin-axial connector element 400 is mated with a mating twin-axial connector element.

Further, it is clear for a person skilled in the art, that the first electrical insulator element 402 may be manufactured by any of the fabrication processes described for the first embodiment of the present invention. Similarly, the first contact support part 414 may be formed of any of the materials mentioned for the first contact support part 114 the first embodiment, and the first compensation part 416 may be formed of any of the materials mentioned for the first compensation part 116 of the first embodiment.

Figure 5:
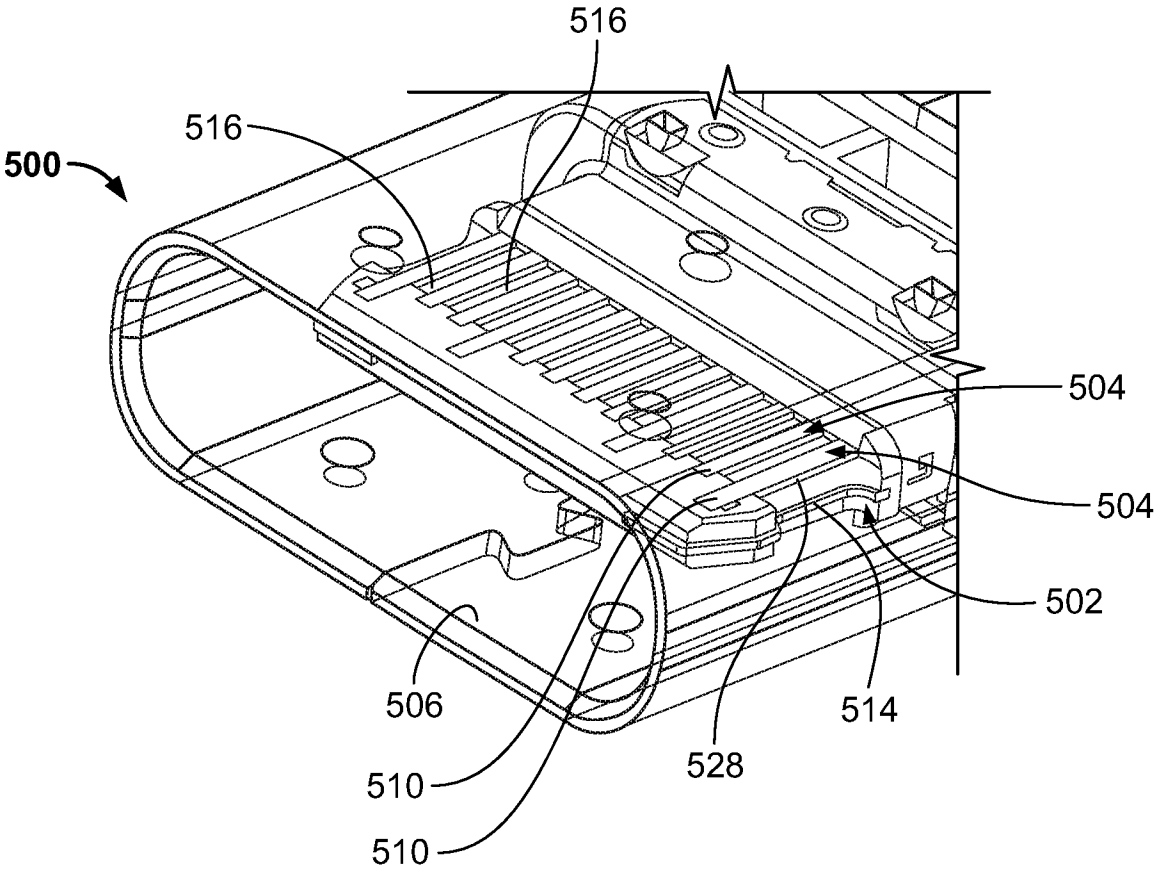
FIG. 5 is a perspective view of a first RF connector element according to another embodiment.

FIG. 5 shows a schematic top view of the first RF connector element according to a third embodiment of the present invention. In the example of the third embodiment, the RF connector system is a USB connector system and the first RF connector element is a first USB connector element 500. The first USB connector element 500 comprises a plurality of inner conductors 504, which are an example for a plurality of terminals comprised by a RF connector element. Each of the first inner conductors 504 has a first contact region 510, for electrically connecting corresponding mating terminals of a second USB connector element. In an embodiment, the first USB connector element 500 may have a first outer conductor 506, which surrounds the plurality of inner conductors 504, for shielding the plurality of inner conductors 504.

The first USB connector element 500, as shown in FIG. 5, has a first electrical insulator element 502, which may be also signified as a first tongue member. The first electrical insulator element 502 comprises a first contact support part 514, which is formed of the first dielectric material, having a first relative dielectric constant, and a first compensation part 516, which is formed of a second dielectric material, having a second relative dielectric constant, which is larger than the first relative dielectric constant. According to the present invention, the first compensation part 516 is integrally formed with the first contact support part 514. Further, the first compensation part 516 is arranged at a front end region of the first electrical insulator element 402, so that in the first compensation part 416 at least partially encompasses the plurality of contact regions 510. As shown in FIG. 5, this may be realized by sandwiching the first contact support part 514 in between the first compensation part 516, so that the plurality of inner conductors 504 are in direct contact with the first contact support part.

As shown in FIG. 5, the first compensation part 516 is of substantially rectangular shape and comprises a plurality of compensation recesses 528, for receiving the plurality of first contact regions 510. In this manner, the first compensation part 516 increases the capacitance between the plurality of inner conductors 504 near the plurality of first contact regions 510. Thus, a capacitance drop can be compensated, that is induced by an air gap in the neighborhood of the plurality of first contact regions 510, when the first USB connector element 500 is mated with a second USB connector element.

It is clear for a person skilled in the art, that the first electrical insulator element 502 may be manufactured by any of the fabrication processes described in another embodiment of the present invention. Similarly, the first contact support part 514 may be formed of any of the materials mentioned for the first contact support part 114 in another embodiment, and the first compensation part 516 may be formed of any of the materials mentioned for the first compensation part 116 of another embodiment.

In the following, the effect of the first electrical insulator element 102 comprising the first compensation part 116 on the signal transmission performance of the coaxial connector system 1000 according to the first embodiment of the present invention will be shown in FIGS. 6-9.

Figure 6:
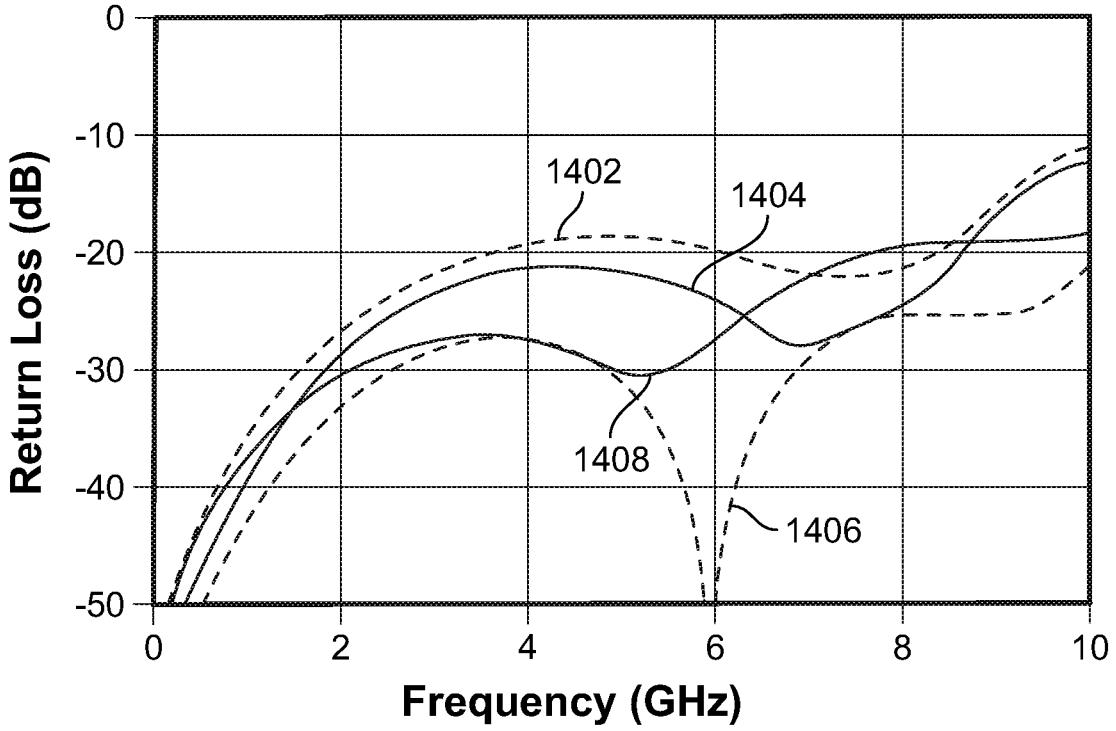
FIG. 6 is a graph showing simulation results of a return loss of the RF connector system for different contact gap variations.
Figure 7:
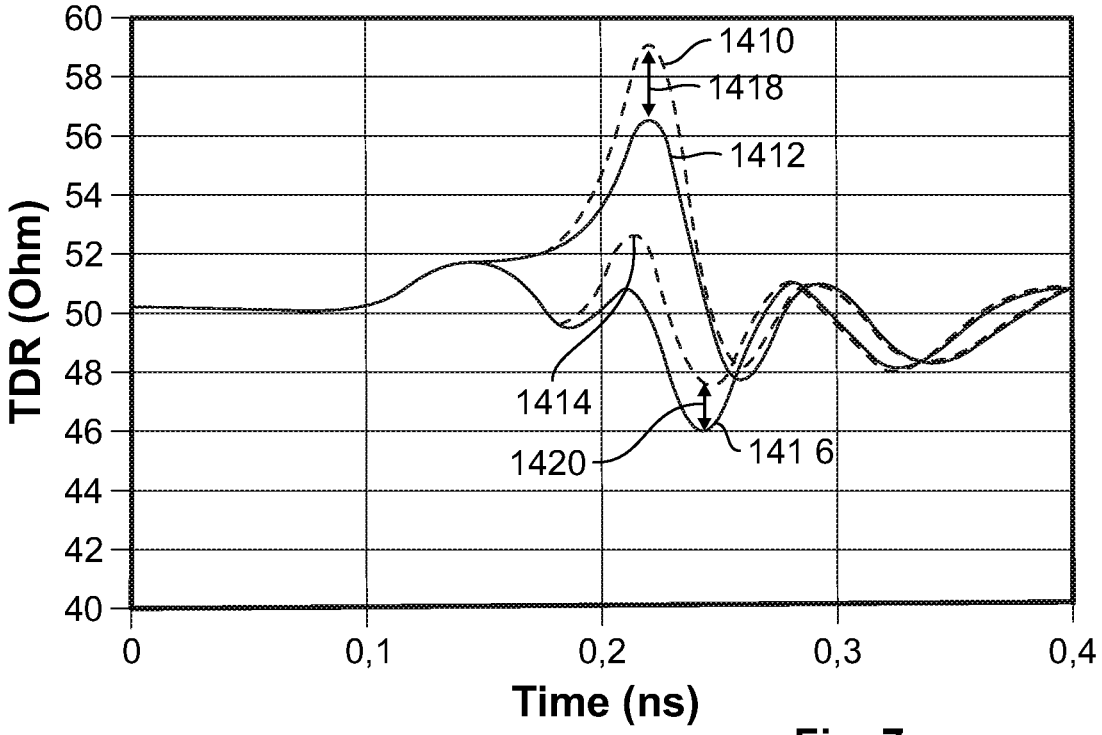
FIG. 7 is a graph showing simulation results of a time-domain reflectometry (TDR) of the RF connector system for different contact gap variations.

FIGS. 6 and 7 show graphs indicating simulation results of a return loss as a function of the frequency of a transmitted signal (FIG. 6) and of a time-domain reflection (TDR) as a function of the time (FIG. 7) for the coaxial connector system 1000 comprising the first coaxial connector element 100, as shown in FIGS. 1-3. Hereby, the simulations were done for different examples of air gaps 300 and for different examples of second relative dielectric constants of the first compensation part 116. Here, the TDR has been simulated for a pulse rise time of 60 ps.

Dashed lines 1402 and 1410 each show simulation results for an air gap 300 of 0.8 mm (as illustrated by FIGS. 3 and 4) and for the first compensation part 116 formed of a second dielectric material having a second relative dielectric constant equal to the first dielectric constant, i.e. between 1 and 5. Solid Lines 1404 and 1412 each show simulation results for an air gap 300 of 0.8 mm and for the first compensation part 116 formed of a second dielectric material having a second relative dielectric constant equal to 13, i.e. larger than the first relative dielectric constant.

Dashed lines 1406 and 1414 in FIGS. 6 and 7 each show simulation results for an air gap 300 of 0 mm (as shown in FIGS. 1 and 2) and for the first compensation part 116 formed of a second dielectric material having a second relative dielectric constant equal to the first dielectric constant, i.e. between 1 and 5. Solid lines 1408 and 1416 each show simulation results for an air gap 300 of 0 mm and for the first compensation part 116 formed of a second dielectric material having a second relative dielectric constant equal to 13, i.e. larger than the first relative dielectric constant.

As apparent from theses graphs and in particular from the graph in FIG. 7, the use of a second dielectric material with a higher relative dielectric constant reduces the maximal deviation of the TDR from the nominal impedance value, which here is for example 50 Ohm. The reduction of the maximal deviation is indicated by an arrow 1418, and is in this example about 3 Ohm for an air gap 300 of 0.8 mm. At the same time, the maximal deviation of the TDR from the nominal impedance value, indicated by an arrow 1420, stays almost constant for an air gap 300 of 0 mm.

Hence, it is shown that the first compensation part 116 formed of the second dielectric material with the second relative dielectric constant higher than the first relative dielectric constant can suppress the influence of the air gap 300 on the impedance of the coaxial connector system 1000. In particular, the first compensation part 116 reduces the maximal deviation from the nominal impedance value to be in an acceptable range of 10 percent around the nominal impedance value for both 0 and 0.8 mm air gaps 300. Consequently, the present invention can increase the tolerance of the signal transmission performance towards the air gap 300.

Figure 9:
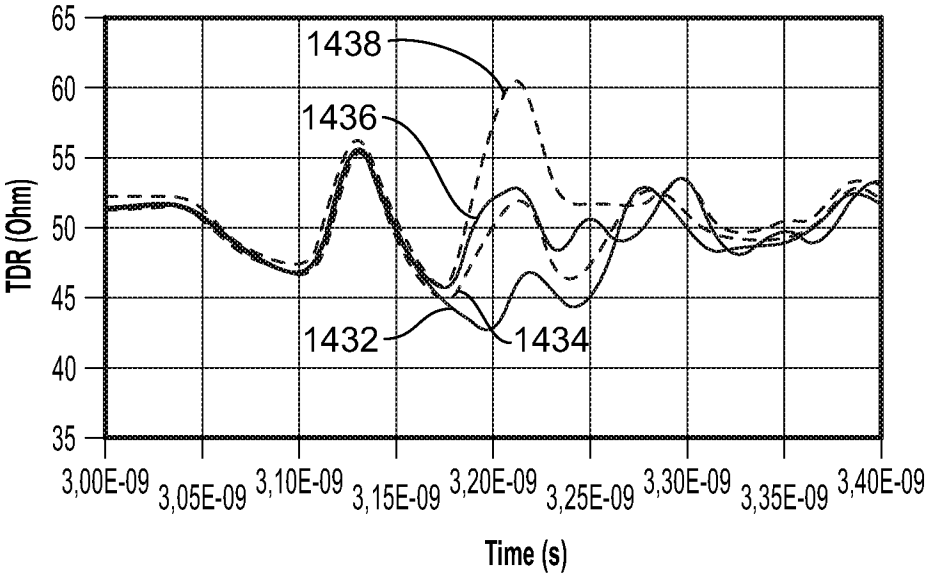
FIG. 9 is a graph of measurement results of the TDR of the RF connector system for different contact gap variations.
Figure 8:
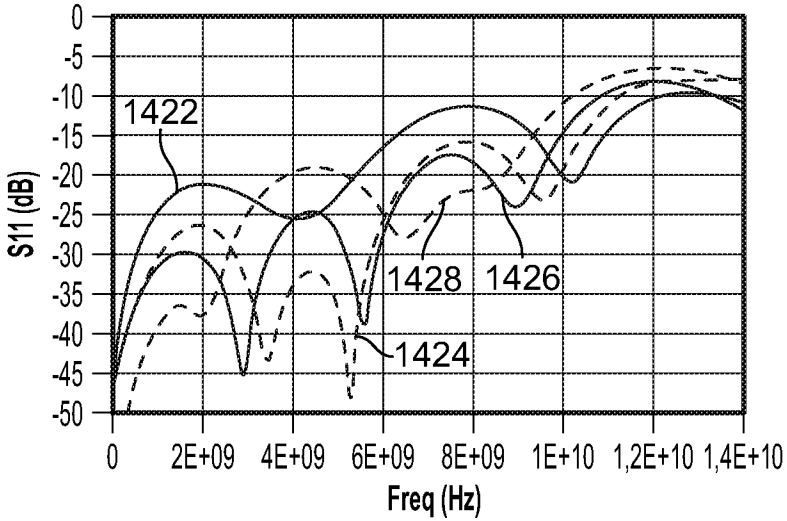
FIG. 8 is a graph of measurement results of a return loss of the RF connector system for different contact gap variations.

FIGS. 8 and 9 show graphs indicating measurement results of the return loss S11 as a function of the frequency of a transmitted signal (FIG. 8) and of the TDR as a function of the time (FIG. 9) for the coaxial connector system 1000 comprising the first coaxial connector element 100, as shown in FIGS. 1 to 3. Here, the TDR has been measured for a pulse rise time of 20 ps.

Solid lines 1422 and 1432 in FIGS. 8 and 9 each show measurement results for an air gap 300 of 0 mm (as shown in FIGS. 1 and 2) and for the first compensation part 116 formed of a second dielectric material having a second relative dielectric constant equal to 13, i.e. larger than the first dielectric constant. Dashed Lines 1424 and 1434 each show measurement results for an air gap 300 of 0 mm and for the first compensation part 116 formed of a second dielectric material having a second relative dielectric constant equal to the first relative dielectric constant, i.e. between 1 and 5.

Solid lines 1426 and 1436 in FIGS. 8 and 9 each show measurement results for an air gap 300 of 1.0 mm and for the first compensation part 116 formed of a second dielectric material having a second relative dielectric constant equal to 13, i.e. larger than the first dielectric constant. Dashed Lines 1428 and 1438 each show measurement results for an air gap 300 of 1.0 mm and for the first compensation part 116 formed of a second dielectric material having a second relative dielectric constant equal to the first relative dielectric constant, i.e. between 1 and 5.

The measurement results of FIGS. 8 and 9 confirm the simulation results of FIGS. 6 and 7. In particular, FIG. 8 shows an improvement of the high-frequency bandwidth for a −10 dB-return loss by addition of the first compensation part 116 with a higher relative dielectric constant. In detail, for the air gap 300 of 1 mm, the return loss is below −10 dB only for frequencies below 10 GHz for the first compensation part 116 having a dielectric constant equal to the first contact support part 114, while the return loss is below −10 dB for frequencies up to around 11 GHz for the first compensation part 116 having a higher relative dielectric constant. For the air gap 300 of 0 mm, the return loss is below −10 dB only for frequencies below around 11.5 GHz for the first compensation part having a dielectric constant equal to the first contact support part, while the return loss is below −10 dB for frequencies up to around 12 GHz for the first compensation part having a higher relative dielectric constant.

FIG. 9 again shows, that the use of the first compensation part 116 with the high dielectric material can significantly reduce the maximum deviation of the TDR from the nominal value for an air gap 300 of 1 mm. Consequently, for both air gaps 300 of 0 and of 1 mm, the deviation of the TDR stays within an acceptable tolerance of 10 percentage within the whole frequency range. Hence, the use of the first compensation part 116 can significantly reduce the influence of the air gap 300 on the signal transmission performance of the first connector element 100 for air gaps up to 1 mm, and therefore allows the use of linear fastening mechanisms, which may induce such air gaps, without decreasing the data transmission performance of the RF connector system 1000 having the first RF connector element 100. This is in particular important for arrays of multiple RF connector elements, that have to be plugged simultaneously.

Figure 10:
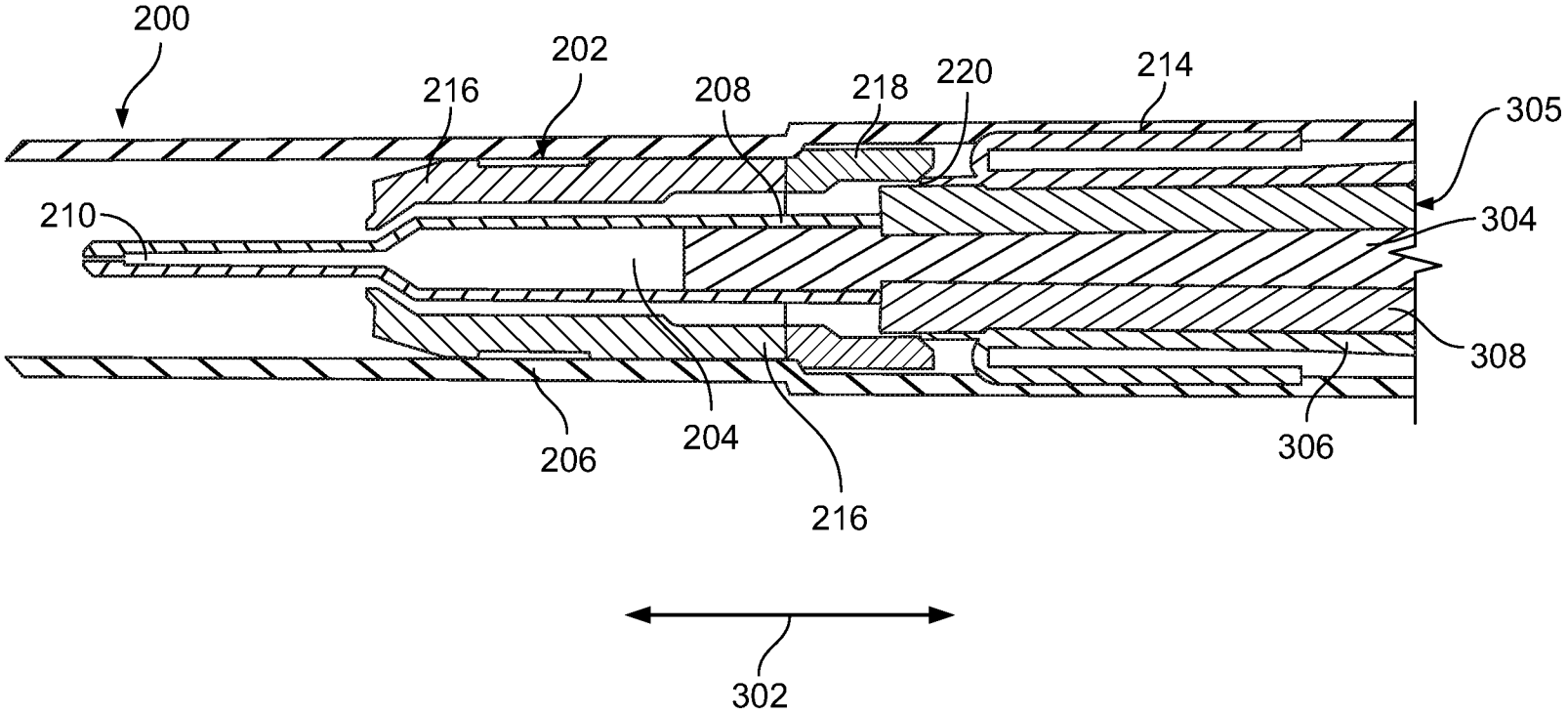
FIG. 10 is a sectional side view of a second RF connector element according to an embodiment.

FIG. 10 shows a schematic cross-sectional view of the second coaxial connector element 200 according to the first embodiment of the present invention, which will be described in the following in detail.

As described above, the second coaxial connector element 200 comprises the second electrical insulator element 202, the first mating inner conductor 204 and the first mating outer conductor 206 arranged in a conventional manner.

As shown in FIG. 10, the first mating inner conductor 204 comprises a first mating terminal contact region 210, which may be a pin-like member, for electrically connecting the first contact region 110 of the first connector element 100. For electrically connecting the transmission line 304 of a coaxial cable element 305, the first mating inner conductor 204 comprises a first mating terminal end region 208. Further, the first mating inner conductor 204 may comprise a second barb, which may engage with a second recess comprised by the second electrical insulator element 202. In this manner, the second barb can prevent a movement of the first mating inner conductor 204 with respect to the second electrical insulator element 202 in the longitudinal direction 302, after manufacturing of the second coaxial connector element 200.

The first mating outer conductor 206 surrounds the first mating inner conductor 204, for shielding the first mating inner conductor 204. Further, the first mating outer conductor 206 may comprise a depression, which prevents the movement of the first mating outer conductor 206 with respect to the second electrical insulator element 202 in the longitudinal direction 302, after manufacturing of the second coaxial connector element 200.

For electrically connecting the first mating outer conductor 206 to a grounding line 306 of the coaxial cable element 305, as shown in FIG. 10, the first mating outer conductor 206 has a second mating terminal end region 214. For example, the first mating outer conductor 206 and the grounding line 306 can be electrically connected by conventional methods, such as crimping or soldering. However, a person skilled in the art will understand, that also any other conventional method may be used for electrically connecting the first mating outer conductor 206 to the grounding line 306.

The second electrical insulator element 202 has a second contact support part 216 and a second compensation part 218, shown in FIG. 10, which is integrally formed with the second contact support part 216, so as to form a single part. The second contact support part 216 is integrally formed of a third dielectric material, which has a third relative dielectric constant. The second compensation part 218 is integrally formed of a fourth dielectric material, which has a fourth relative dielectric constant, which is larger than the third relative dielectric constant.

As shown in FIG. 10, the second compensation part 218 is arranged at a rear end portion of the second electrical insulator element 202 and at least partly surrounds first mating terminal end region 208 of the first mating inner conductor 204. Optionally, the second compensation part 218 may protrude above the first mating terminal end region 208 of the first mating inner conductor 204 and may comprise a second contact aperture 220, which is capable of at least partly receiving a coaxial cable insulator element 308, that electrically insulates the transmission line 304 and the grounding line 306.

With this arrangement, the compensation part 218 can enhance the capacitance between the first mating inner conductor 204 and the first mating outer conductor 206 in the neighborhood of the first mating terminal end region 208. Accordingly, a capacitance drop can be compensated, which is caused by pig tailing of the transmission line 304 of the coaxial cable 305, necessary for electrically connecting the transmission line 304 to the first mating terminal end region 208 of the first mating inner conductor 204. Due to this capacitance compensation, the signal transmission performance of the coaxial connector system 1000 can be further enhanced.

In order to provide an isotropic electric insulation and an isotropic capacitance between the first mating inner conductor 204 and the first mating outer conductor 206, the second contact support part 216 and the second compensation part 218 may be substantially ring-shaped.

In an embodiment, the second contact support part 216 is formed of a polymer, a resin or a rubber. For example, the second contact support part 216 is formed of a dielectric material, which is injection-moldable, such as a polyethylene (PE) or a polypropylene (PP). However, the second contact support part 216 may also be formed of a material that is processed by ram extrusion, like polytetrafluoroethylene (PTFE), or may be formed of a dielectric material, which is a 3D-printable ceramic. Typically, such materials have a relative dielectric constant in a range between 1 and 5.

In order to provide a homogeneous capacitance in the coaxial connector system 1000, in an embodiment, the first contact support part 114 and the second contact support part 216 are formed of the same material, thus having the same relative dielectric constant. In this way, also the manufacturing of the first contact support part 114 and the second contact support part 216 can be unified and therefore simplified.

In order to realize a high fourth relative dielectric constant, the fourth dielectric material may be fabricated by ceramic powder filling of a plastic base material. In an embodiment, the fourth dielectric material can be an injection-moldable polymer mixed with a mineral, such as barium titanate ($BaTiO_3$). By optimizing the volume fraction of the mineral, a range between 8 and 23 can be achieved for the fourth relative dielectric constant for a transmission signal frequency of 1 GHz. Alternatively, the fourth dielectric material may be any 3D-printable ceramic with a relative dielectric constant that is larger than the third dielectric constant of the third dielectric material. Alternatively, the fourth dielectric material may be a dispensable semi-liquid mixed with a mineral. For example semi-liquids mixed with a mineral, such as $BaTiO_3$, are known, that have a relative dielectric constant of 35 at a frequency of 1 GHz.

In an embodiment, the second electrical insulator element 202 is manufactured by a fabrication process which is known in the art as overmolding or as multi material injection molding. Thereby, the second contact support part 216 is initially manufactured by injection molding of the third dielectric material and subsequently the second compensation part 218 is overmolded onto the first contact support part 216 by injection molding of the fourth dielectric material.

In this manner, the second electrical insulator element 202 can be manufactured as a single part, so that the second coaxial connector element 200 can be assembled from the second electrical insulator element 202, the first mating inner conductor 204 and the first mating outer conductor 206 in a well-established manner. Further, injection molding and overmolding provide a reliable and inexpensive manufacturing technique for miniaturized coaxial connector elements. For example, it is possible with these techniques to manufacture the second electrical insulator element 202 as shown in FIGS. 1 and 2 and FIG. 10 with a first outer diameter 128 of 2 mm, and to fabricate the first compensation part 116 with a thickness of 2 mm in the longitudinal direction 302. However, these dimensions are merely given as examples, to illustrate the general dimensions of a miniaturized second coaxial connector element 200, and are not meant to be restrictive, as the aspects of the present invention may also be applied to a coaxial connector system 1000 with larger or even smaller dimensions.

Further, it may be useful to vary the thickness of the second compensation part 218 in the longitudinal direction 302 based on a ratio of the third relative dielectric constant and the fourth relative dielectric constant. For example, the thickness of the second compensation part 218 in the longitudinal direction 302 can be increased, when the ratio of the third relative dielectric constant and the fourth relative dielectric constant decreases, and can be decreased, when the ratio of the third relative dielectric constant and the fourth relative dielectric constant increases. In this way, it is possible to optimize the compensation of the capacitance drop caused by pig tailing of the transmission line 304 and to enhance the signal transmission performance of the second coaxial connector element 200. To optimize the operation bandwidth and the signal transmission performance of the second RF connector element 200, the ratio between the third relative dielectric constant and the fourth relative dielectric constant is in a range between 1/35 and 5/8.

Alternatively, the second compensation part 218 may be fabricated by dispensing a dispensable semi-liquid in a dispensing volume after the second contact support part 216 is manufactured. As another alternative, 3D printing may be used in combination with suitable dielectric materials to manufacture the second electrical insulator element 202 as a single part comprising the first contact support part 216 and the first compensation part 218.

In order to unify and simplify the manufacturing process of the coaxial connector system 1000, in an embodiment, the same material is used as the second dielectric material and as the fourth dielectric material. Hence, the second relative dielectric constant and the fourth relative dielectric constant are equal.

With reference to FIGS. 1, 2 and 10, an embodiment has been explained in detail where the second RF connector element is a second coaxial connector element 200, hence comprising an inner conductor for transmitting a RF signal, and an outer conductor for shielding the inner conductor. However, the present invention is not limited to coaxial connector systems, but may also be applied to RF connector systems, such as twin-axial connector systems or USB connector systems, which comprise a plurality of inner conductors, either shielded or unshielded.

In the twin-axial connector system or the USB connector system, the second compensation part 218 may be formed in such a way, that it can be arranged in between each of the mating terminal end regions of the plurality of inner conductors. In this manner, it is possible to optimize the compensation of the capacitance drop caused by pig tailing of a RF cable element that has a plurality of transmission lines, each electrically connected to one of the plurality of inner conductors.

Figure 11:
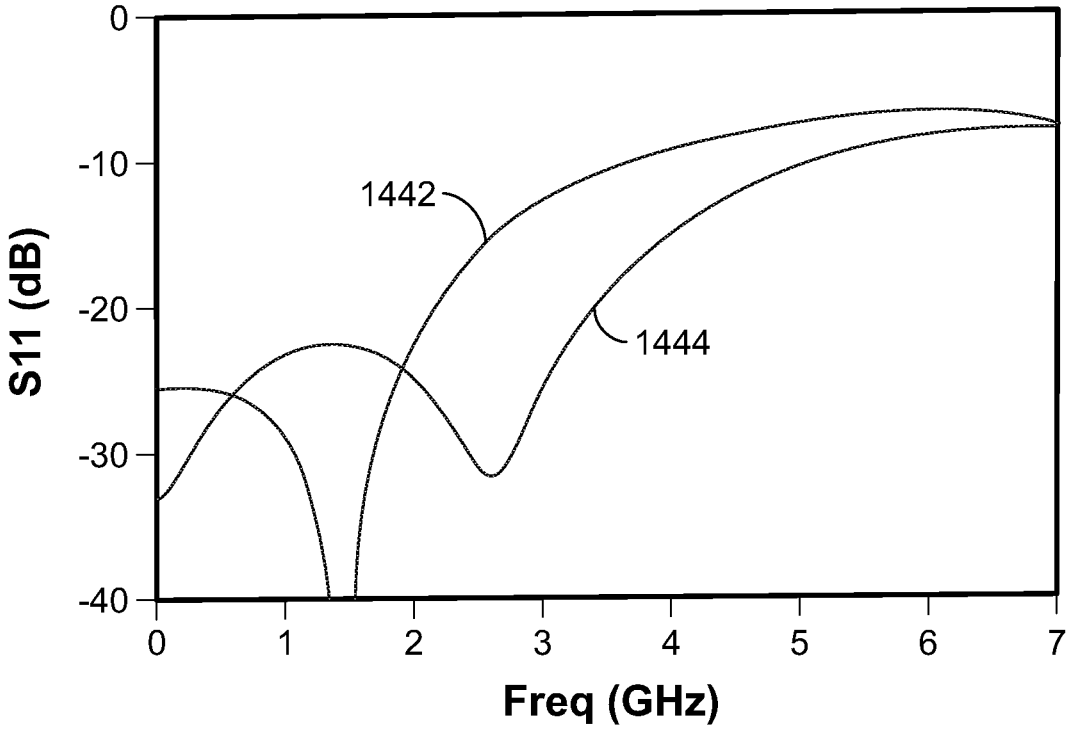
FIG. 11 is a graph of measurement results indicating an influence of a second compensation part on the return loss of the RF connector system.
Figure 12:
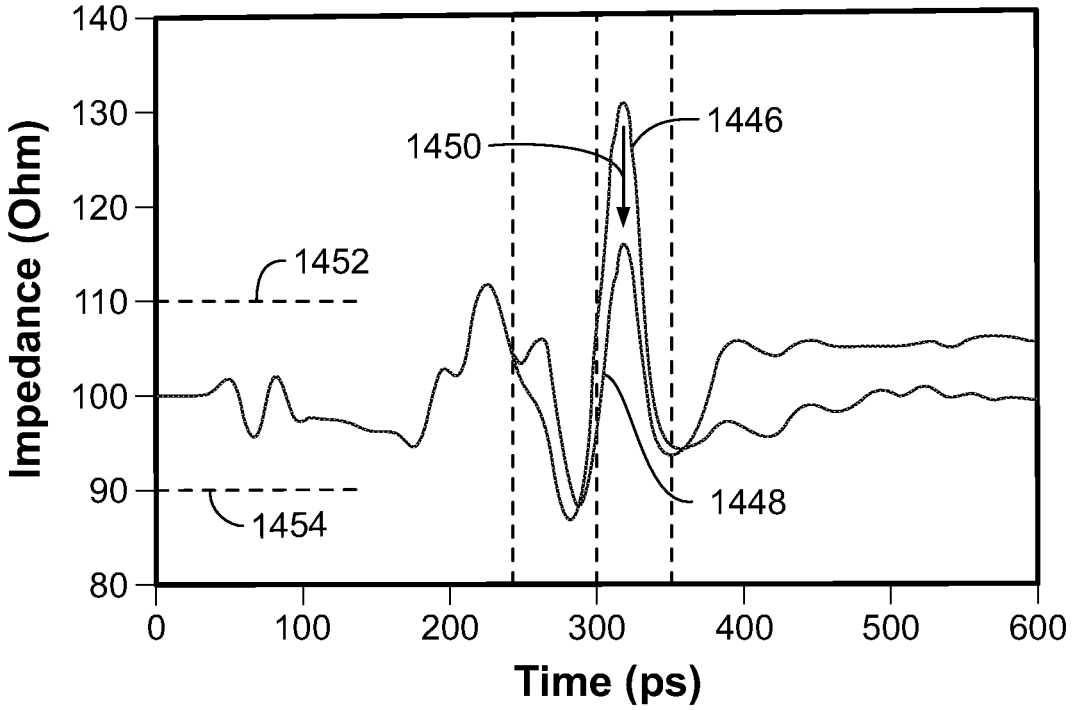
FIG. 12 is a graph of measurement results indicating the influence of the second compensation part on the TDR of the RF connector system.

The effect of the second compensation part 218 on the performance of an RF connector system will be shown in the following by FIGS. 11 and 12. FIGS. 11 and 12 show graphs indicating measurement results of the return loss S11 as a function of the frequency of a transmitted signal (FIG. 11) and of the TDR as a function of the time (FIG. 12) for exemplary RF connector systems. Here, the TDR has been measured for a pulse rise time of 50 ps.

In FIGS. 11 and 12, solid lines 1442 and 1446 each show measurement results for an RF connector system comprising the second compensation part 218 formed of a fourth dielectric material having a fourth relative dielectric constant equal to the third relative dielectric constant, i.e. between 1 and 5. Solid lines 1444 and 1448 each show measurement results for an RF connector system comprising the second compensation part 218 formed of a fourth dielectric material having a fourth relative dielectric constant equal to 11, i.e. larger than the third relative dielectric constant.

FIG. 11 shows an improvement of the high-frequency bandwidth for a −15 dB-return loss by addition of the second compensation part 116 with a higher relative dielectric constant. In particular, an increase of the −15 dB operating bandwidth from 2.5 to 4 GHz is shown, when the second compensation part 116 has the fourth relative dielectric constant, that is higher than the third relative dielectric constant. In other words, the coverage of the operation bandwidth is increased by 60%, which means that a channel capacity of the transmission channel can be increased from below 5 to 7.5 Gbps.

FIG. 12 shows that the use of the second compensation part 218 with the fourth relative dielectric constant, that is higher than the third relative dielectric constant, can significantly reduce the maximum deviation of the TDR from the nominal value, which is 100 Ohm in this example. This is indicated by the arrow 1450. Hence, the use of the second compensation part 218 with the higher relative dielectric constant further reduces the maximal deviation of the TDR from the nominal value, so as to stay within an acceptable tolerance of 10 percentage (indicated by the dashed lines 1452 and 1454) above the whole frequency range. Hence, by using the second compensation part 218 with the higher relative dielectric constant, the signal transmission performance of the RF connector system can be further enhanced.

It should be mentioned here that so far the first RF connector element according to the present invention has been exemplified by a receptacle, while the second RF connector element has been exemplified by a pin. However, it is obvious for a person skilled in the art that aspects of the present invention, which are explained on the example of the first RF connector element, may also be applied to the second RF connector element. Similarly, aspects of the present invention, which are explained on the example of in the second RF connector element, may also be applied to the first RF connector element.

In particular, the first electrical insulator element may, in addition to the first compensation part, comprise a second compensation part, which is integrally formed with the first contact support part and at least partly surrounds the first terminal end region of the first inner conductor. Similarly, the second electrical insulator element may, in addition to the second compensation part, comprise a first compensation part, which is integrally formed with the second contact support part and is arranged at a front end region of the second electrical insulator element.

What is claimed is:

1. A first RF connector element for mating with a second RF connector element, comprising:

a first terminal having a first contact region electrically connecting with a first mating terminal of the second RF connector element;

a second terminal having a second contact region electrically connecting with a second mating terminal of the second RF connector element; and a first electrical insulator element electrically insulating the first terminal and the second terminal, the first electrical insulator element has a first contact support part and a first compensation part, the first contact support part is integrally formed of a first dielectric material and has a first relative dielectric constant, the first compensation part is integrally formed in a single piece with the first contact support part of a second dielectric material different from the first dielectric material, the second dielectric material having a second relative dielectric constant greater than the first relative dielectric constant, the first compensation part is arranged at a front end region of the first electrical insulator element and at least partly encompasses the first contact region.

2. The first RF connector element of claim 1, wherein the first terminal is a first inner conductor and the second terminal is a first outer conductor that surrounds the first inner conductor.

3. The first RF connector element of claim 1, wherein the first terminal is a first inner conductor and the second terminal is a second inner conductor.

4. The first RF connector element of claim 3, further comprising a first outer conductor surrounding the first terminal and the second terminal.

5. The first RF connector element of claim 1, wherein a ratio between the first relative dielectric constant and the second relative dielectric constant is in a range between 1/35 and 5/8.

6. The first RF connector element of claim 1, wherein the first electrical insulator element is produced by injection molding the first contact support part from the first dielectric material and subsequently overmolding the first compensation part from the second dielectric material.

7. The first RF connector element of claim 1, wherein the first terminal is a receptacle.

8. The first RF connector element of claim 1, wherein:

the first terminal includes a first inner conductor and a second inner conductor for defining a twin-axial connector element; and the first electrical insulator element electrically insulates the first inner conductor and the second inner conductor.

9. A second RF connector element for mating with a first RF connector element, comprising:

a first mating terminal having a first mating terminal contact region electrically connecting with a first terminal of the first RF connector element and a first mating terminal end region electrically connecting with a first conductor of an RF cable element;

a second mating terminal having a second mating terminal contact region electrically connecting with a second terminal of the first RF connector element and a second mating terminal end region electrically connecting with a second conductor of the RF cable element; and a second electrical insulator element electrically insulating the first mating terminal and the second mating terminal, the second electrical insulator element has a second contact support part and a second compensation part, the second contact support part is integrally formed of a third dielectric material and has a third relative dielectric constant, the second compensation part is integrally formed with the second contact support part of a fourth dielectric material, the fourth dielectric material having a fourth relative dielectric constant greater than the third relative dielectric constant, the second compensation part is arranged at a rear end region of the second electrical insulator element and at least partly between the first mating terminal end region and the second mating terminal end region.

10. The second RF connector element of claim 9, wherein a ratio between the third relative dielectric constant and the fourth relative dielectric constant is in a range between 1/35 and 5/8.

11. The second RF connector element of claim 9, wherein the second electrical insulator element is fabricated by injection molding the second contact support part from the third dielectric material and subsequently overmolding the second compensation part from the fourth dielectric material.

12. The second RF connector element of claim 9, wherein the first mating terminal is a pin.

13. The second RF connector element of claim 9, wherein the third dielectric material is different from the fourth dielectric material.

14. An RF connector system, comprising:

a first RF connector element including:

a first terminal having a first contact region;

a second terminal having a second contact region; and a first electrical insulator element electrically insulating the first terminal and the second terminal, the first electrical insulator element has a first contact support part and a first compensation part, the first contact support part is integrally formed of a first dielectric material and has a first relative dielectric constant, the first compensation part is integrally formed with the first contact support part of a second dielectric material, the second dielectric material having a second relative dielectric constant greater than the first relative dielectric constant, the first compensation part is arranged at a front end region of the first electrical insulator element and at least partly encompasses the first contact region; and a second RF connector element mating with the first RF connector element and including:

a first mating terminal having a first mating terminal contact region electrically connecting with the first terminal and a first mating terminal end region electrically connecting with a first conductor of an RF cable element;

a second mating terminal having a second mating terminal contact region electrically connecting with the second terminal and a second mating terminal end region electrically connecting with a second conductor of the RF cable element; and a second electrical insulator element electrically insulating the first mating terminal and the second mating terminal, the second electrical insulator element has a second contact support part and a second compensation part, the second contact support part is integrally formed of a third dielectric material and has a third relative dielectric constant, the second compensation part is integrally formed with the second contact support part of a fourth dielectric material, the fourth dielectric material having a fourth relative dielectric constant greater than the third relative dielectric constant, the second compensation part is arranged at a rear end region of the second electrical insulator element and at least partly between the first mating terminal end region and the second mating terminal end region.

15. The RF connector system of claim 14, wherein the first compensation part at least partly surrounds the first mating terminal contact region when the first RF connector element and the second RF connector element are mated.

16. The RF connector system of claim 14, wherein the second relative dielectric constant and the fourth relative dielectric constant are equal.

17. The RF connector system of claim 14, wherein the first relative dielectric constant and the third relative dielectric constant are equal.

18. The RF connector system of claim 14, wherein the second dielectric material is different from the first dielectric material.

19. The RF connector system of claim 18, wherein the third dielectric material is different from the fourth dielectric material.

20. The RF connector system of claim 14, wherein an air gap is defined between a front surface of the first compensation part and an opposing front surface of the second compensation part in a longitudinal direction of the connector system.

* * * * *